US005139705A

United States Patent [19]

Wittpenn, Jr. et al.

[11] Patent Number: 5,139,705

[45] Date of Patent: Aug. 18, 1992

[54] COMPOSITIONS EMPLOYING NONIONIC SURFACTANTS

[76] Inventors: John R. Wittpenn, Jr., 57 Poinsettia Ave., Weymouth, Mass. 02188; richard L. Giovanoni, 220 Richmond St., East Taunton, Mass. 02718

[21] Appl. No.: 301,390

[22] Filed: Jan. 25, 1989

Related U.S. Application Data

[62] Division of Ser. No. 34,043, Apr. 3, 1987, Pat. No. 5,000,868.

[51] Int. Cl.[5] ..... C11D 1/18; C11D 9/50

[52] U.S. Cl. ..... 252/547; 252/106; 252/174.22

[58] Field of Search ..... 252/547, 174.22

[56] References Cited

U.S. PATENT DOCUMENTS 3,943,234 3/1976 Roggenkamp ..... 252/142

3,950,417 4/1976 Verdicchid et al. ..... 252/545

*Primary Examiner*—A. Lionel Clingman

*Attorney, Agent, or Firm*—Watson, Cole, Grindle & Watson

[57] ABSTRACT

A mild, non-irritating surfactant composition, which includes an anionic surfactant, an amine oxide, a nonionic surfactant having a relatively low melting point, and a nonionic surfactant having a high melting point relative to the low melting point nonionic surfactant.

12 Claims, No Drawings

COMPOSITIONS EMPLOYING NONIONIC SURFACTANTS

This application is a divisional application of application Ser. No. 034,043, filed Apr. 3, 1987 now issued as U.S. Pat. No. 5,000,868.

BACKGROUND OF THE INVENTION

The present invention relates generally to surfactant compositions. More particularly, it relates to a surfactant composition which is composed of a combination of surfactants that make it an effective cleansing agent, but with non-irritating properties such that it is especially effective for use on periocular and ocular surface tissues.

For some time a desirable surfactant product has been sought in which the advantageous foaming properties of an anionic surfactant can be maintained while avoiding the irritation to the skin that such surfactants normally cause. The characteristic of irritating sensitive human skin and membranes is particularly evident when the surfactant is to be utilized in the vicinity of the human eye. Such surfactants or shampoos have previously been utilized to help in the control of oily debris, cosmetics and encrusted material that may form on the scalp and face. Yet there is definite need for a surfactant composition for use in conditions requiring good eyelid and eyelash cleansing.

An example of one such condition is acute and chronic blepharitis. Blepharitis is an inflammation of the eyelids that arises in the glands found at the base of the eyelashes (glands of Zeis and Moll) and just behind the eyelashes (meibomian glands). These glands secrete an oily lipid material (meibom), which is essential for maintenance of the normal tear film on the ocular surface as well as the natural lubrication of the eyelids. When these glands become inflamed or clogged by thickened secretions, cosmetics, infection, or other causes not yet identified, the surrounding tissues become inflamed. The resulting inflammation of the eyelids and ocular surface is called blepharitis and can produce a variety of symptoms of ocular dysfunction. These symptoms may include but not be limited to any or all of the following: irritation, itching, burning, dryness, tearing, redness of the eyelids and conjunctiva, filmy vision, chalazion or hordeolum formation, and loss of eyelashes. Severe cases can even produce corneal opacification and decreased vision.

The mainstay of present therapy for blepharitis is the combined use of warm compresses and daily lid hygiene to clean the oily secretions, crusting and other forms of debris which accumulate on the eyelids and eyelashes, thereby exacerbating the inflammatory problem. Certain oral and topical medications are then added to this primary therapy as needed in each individual case. However, at present there is no cleansing surfactant product specifically designed for use by the patient to clean the eyelids and eyelashes. Therefore eye care professionals currently recommend the use of mineral oil or mild hair shampoos. These shampoos must be diluted by the patient with water to reduce the irritancy of the cleansing component in the shampoo. Despite using dilute hair shampoos, many patients develop a secondary ocular irritation from the cleansing agents, themselves. These shampoos have the additional disadvantage of containing dyes and/or perfumes which do not enhance the cleansing potential but may act as ocular irritants.

Consequently, a desirable surfactant product combines the advantages of foaming and cleansing properties of anionic surfactants with other surfactants and pharmaceutical agents such that the resulting composition is nonirritating to skin, periocular tissues and ocular surface tissue. It is, therefore, a primary object of the present invention to provide such a surfactant composition which maintains the foaming and cleansing characteristics of an anionic surfactant, while at the same time significantly ameliorating the irritating characteristics of such anionics. This surfactant composition is suitable for use in those conditions requiring daily lid hygiene such as blepharitis. This surfactant composition has further utility as a nonirritating cleanser of cosmetics. It is a further object to provide such a surfactant composition that can be used to effectively clean skin, mucous membrane and ocular surface tissue prior to invasive and noninvasive treatments while avoiding the introduction of concomitant irritation. Finally, it is a further object to provide such a surfactant composition which can be used to cleanse nonbiological surfaces, which are then placed on or near the eye.

These and other objects of the present invention will become more apparent to one of skill in this art from the summary and detailed description of the invention provided hereinafter.

SUMMARY OF THE INVENTION

Our invention is, in its broad form, a mild, non-irritating surfactant composition having good foaming characteristics. The composition comprises an anionic surfactant with high foaming properties and only mildly irritating to human tissues; non-ionic surfactants capable of reducing the irritant properties of the anionic surfactant and also of emulsifying and solubilizing physiologic debris, and an induced non-ionic surfactant which enhances the foaming properties of the anionic surfactant while further reducing the irritating characteristics of the anionic surfactant.

The induced non-ionic surfactant, as we use that term herein, may take the form of an amine oxide, e.g., coco amido propyl oxide or lauryldimethyl amine oxide or may take the form of an alkanolamide such as Witcamide STD-HP manufactured by Witco Chemical Corp. of NY. The anionic surfactant as used in the surfactant composition of the present invention may be a sulfosuccinate, e.g., disodium laureth sulfosuccinate.

In one form of our invention, the nonionic surfactant is a blend of two nonionic surfactants which, with respect to each other, have relatively high and low melting points. Exemplarily, these melting points may be at about 40° to 44° C. for the low melting point composition and 50° to 54° C. for the high melting point composition. In this way the use of two or more nonionic surfactants can be used to balance the viscosity of the resulting composition. Generally, the two compositions will be used together so that they will be present in combination, in an amount somewhat greater than the amount of anionic detergent utilized.

The surfactant composition of the present invent on will advantageously utilize other materials that will, for example, provide antimicrobial protection. Thus, other materials that may form part of the surfactant composition that we regard as being our invention are disodium edetate, which may be used to adjust the pH of the composition to about 6.7 to 7.5, and benzyl alcohol.

DETAILED DESCRIPTION OF THE INVENTION

The composition of the present invention comprises an anionic surfactant. While there are a wide variety of anionic surfactants suitable for use in the present invention in a satisfactory manner, the surfactant selected for the best mode is one that has the greatest degree of mildness in contact with ocular or other sensitive tissues, yet supplies copious foaming, preferably in the form of microbubbles. Such a high foaming characteristic with a low degree of irritating properties has been achieved by sulfosuccinates, and most specifically by disodium laureth sulfosuccinate, a synonym for which is disodium lauryl alcohol polyglycol ester sulfosuccinate. It is marketed by Sherex Co., of Dublin, OH, under the trademark VARSULF SBFA-30 or by sulfate and sulfonates of ethoxylated alkyl phenols such as Alipal marketed by GAF Corp. of Wayne, NJ. According to the producer's literature, the composition has been evaluated for primary eye irritation n rabbits. 15% and 10% solutions were rated moderately irritating, while a 5% solution was given a mild irritancy rating.

In the preferred embodiment of our invention, a plurality of nonionic surfactants are utilized. The purpose of using such plurality of nonionic surfactants is to do so in a ratio that will permit an adjustment of the vicosity of the resulting composition in water to meet the specific use required. The requirement of the nonionic surfactants is that they be capable of reducing the irritating properties of the anionic surfactant, and also be capable of emulsifying and solubilizing physiologic debris from the surface of the body, particularly oily secretions and collarettes, which are crusted deposits that can form around the eyelash base.

In the best mode of my invention, we prefer to utilize both a relatively low melting point and a relatively high melting point nonionic surfactant. Surfactants that have been found to be well suited for use in the present composition are a series of nonionic, anti-irritant surfactants which generally are ethoxylated mono and diglycerides derived from coconut oil and tallow or a series of nonionic, anti-irritant surfactants which generally are alkanolamides such as coco monoethanol amide marketed as Carsamide CMEA by Lonza, Inc. of Fair Lawn, NJ and/or lauric mono-isopropanolamide marketed as Cyclomide LIPA by Cyclo Chemical Corp. of Miami, FL. Such nonionic surfactants are non-toxic and nonirritating to the skin or eye at the 100% active level and in aqueous dispersions. Further, they impart anti-irritating properties to anionic surfactants, including sulfosuccinates. Moreover, although the non-ionics are only moderate foamers by themselves, they do not depress the foam of high foaming anionic. By utilizing both relatively low and relatively high melting point nonionics, the viscosity of the finished system can be controlled without the use of thickeners that are themselves potentially irritating. Further, the nonionic surfactants should be good emulsifiers and solubilizers for cosmetic creams and lotions where low irritation properties, emollient and viscosity control characteristics are highly desirable.

In the preferred embodiment of our invention, we utilize a combination of two nonionics, one of which is an ethoxylated glyceryl monococoate, as the relatively low melting point nonionic, and ethoxylated glyceryl monotallowate as the relatively high melting point nonionic. The melting point of the monococoate is about 42° C.; that of the monotallowate is about 53° C. When used in predetermined proportions, the combination of these two nonionic surfactants with the remaining ingredients in an aqueous solution may be manipulated so as to achieve desired viscosity, in addition to the other desirable properties of the nonionics. These nonionic surfactants are sold, respectively, under the trademarks VARONIC LI-67, an ethoxylated glyceryl monococoate which has the relatively low melting point, and VARONIC LI-420, an ethoxylated glyceryl monotallowate which has the relatively high melting point. Both VARONIC polymers are sold by Sherex Chemical Co., Inc. of Dublin, OH.

The third ingredient of the composition that forms the basis of the present invention is what we term: an induced nonionic surfactant. Typical of an induced nonionic surfactant is an amine oxide, which is an effective foam stabilizer for anionic surfactants, particularly for fatty alcohol sulfates, alcohol ether sulfates and alpha olefin sulfonates. These amine oxides are noted for their mildness and ease of handling. In neutral or slightly alkaline systems amine oxides behave in the manner of nonionic surfactants; hence the designation, induced nonionic surfactant. In slightly acid systems, they assume mild cationic characteristics, although they remain compatible with anionic surfactants.

By stabilizing the foam of the anionic, the induced nonionic enables the cleansing action of the anionic to continue throughout the scrubbing period. Moreover, it aids in assisting a rinse-off of suds of the anionic at the end of the scrubbing period. Further, the induced nonionic at a pH for the entire composition of approximately 7 exhibits the properties of a nonionic surfactant, thereby enhancing the foaming properties of the product and acting to reduce potential irritancy of the anionic. Further, since the induced nonionic has a change in viscosity building effect in accordance with the pH of the final product—such viscosity increases as the pH of the product decreases—a final adjustment of pH at or about neutrality can serve to increase or decrease the viscosity of the final product according to the specific end use to which it is put. Thus, where a somewhat gelatinous material is desired for application, e.g., to cleansing pads, the viscosity of the present composition can be increased by adjusting to the pH to somewhat below 7, whereas in a solution to be applied on or near the ocular surface, the pH might be maintained at or slightly above 7.

The most preferred induced nonionic, surfactant for use in the present composition is an amine oxide. In the best mode of our invention, we utilize cocoamido propylamine oxide. Such a composition is presently sold by Sherex Co. under the trademark VAROX 1770. This specific amine oxide is substantially non-irritating, and since the entire composition is intended to be substantially non-irritating to sensitive tissues, an amine oxide should be selected which has a very low level of irritancy.

Other materials that form part of the best mode of the present invention are commercially available. Thus, disodium edetate, or ethylene diamine tetracetic acid disodium salt, functions as an anti-microbial agent and also as a pH adjuster. It acts to reduce the pH of the composition to about 7.0 to 7.2 from a range of about 7.5 to 7.8. Disodium edetate is a commonly used preservative in ophthalmic preparations intended for installation directly into the eye. Using disodium edetate to adjust pH obviates the need of adding other agents that have obviously irritating properties, e.g., hydrochloric acid or sodium hydroxide, for that purpose.

In the best mode of the present composition, benzyl alcohol is also utilized. It functions to enhance the antimicrobial action of the disodium edetate, and has its own such action enhanced by the edetate. Benzyl alcohol is especially effective in killing or inhibiting the growth of fungi. Of course, all the ingredients of the subject composition have an inate ability to kill and/or inhibit microbial growth, either by the destruction of cell walls, as in the case of surfactants, or by directly inhibiting metabolic functions of the microbes, as with disodium edetate and benzyl alcohol.

Regarding the quantities utilized of the various materials that are part of the present formulation, to some degree the amount utilized will depend on the desired viscosity of the final composition and the pH thereof. It has, however, in the best mode been found to be most desirable to use quantities so that of the various ingredients will be present in the following amounts by weights: anionic—3%; low melting point nonionic—1%; high melting point nonionic—4%; induced nonionic—2%; disodium edetate—0.05%; benzyl alcohol—0.5%; and water for injection—the remaining 89.45%.

While these various quantities of ingredients represent the best mode of the present invention as presently known to us, it will be obvious that variations thereof can occur in accordance with a range of non-irritating properties and a range of pH and viscosity. For example, when the composition of the present invention is to be used as a makeup remover, the importance of the non-irritating properties of the composition will still be significant, but not as great as if the composition is to be used on or near ocular surfaces. Thus, the ratio of anionic to total nonionic (excluding induced nonionic), can vary from about 1:1 to 1:4, with the preferred ratio being about 3:5 or 1:1.67. However, these are only desirable ranges and, for particular uses, the ranges may be different. With regard to amounts of relatively low to relatively high melting point nonionics, the range can be from 1:1 to 1:8, with 1:4 presently being preferred. The ratio of anionic to induced nonionic will vary advantageously between about 1:0.1 to 1:4, with 1:.67 presently preferred. Quantities of disodium edetate and benzyl alcohol are, as indicated, preferred in quantities of about 0.05 and 0.5%, respectively, of the final solution, which in the most preferred form includes slightly less than 90% water.

The range of pH is about 6.7 to 7.5, more preferably 7.0 plus or minus 0.2. However, for uses where a higher viscosity is desired, the range may be slightly lower, although not so low as to increase substantially the irritant properties of the final composition.

The present process utilized to manufacture the product that is the subject of the best mode embodiment hereof, is to heat all four surfactants in a suitable vessel until they are liquified, being careful not to exceed a temperature greatly above that of the relatively high melting point nonionic which, in the preferred form of monotallowate, has a melting point of about 53° C. In another vessel about 85% of the formula amount of water for injection, which is either deionized, membrane filtered or distilled, is heated to the same temperature as the surfactant phase. One phase is then added to the other with rapid mixing, and after the turbidity clears, the solution is allowed to cool to room temperature with constant, slow mixing. The pH of the solution at this stage of manufacture was found to be about 7.8. Then disodium edetate is added and slow mixing continued until the edetate had totally dissolved and the pH was approximately 7.0. Finally, the benzyl alcohol is added and mixing continued until the solution cleared. Thereafter, the remaining water to bring the total weight to 100%, which in this case would be the final 4.5% water, is added.

After the composition had been produced, it underwent a series of tests to determine whether it was suitable for application to human tissues. Primary eye irritation testing was made, and no irritation was noted during the standard 28-day testing period. In skin maximization allergy testing, no irritation was noted during the standard 35-day testing period. Microbial limits testing was performed to ensure that no pathogens were present, and preservative challenge testing was performed to ensure that the composition in solution met USP requirements as a solution that can inhibit and/or kill microbes upon repeated exposure to the solution.

As formulated, a solution according to the present invention has the ability to ameliorate certain skin conditions associated with blepharitis, as well as rosacea and seborrhea, upon repeated application of warm compresses combined with daily lid hygiene with the present invention. Such lid hygiene was conducted by pouring a few drops of solution of the composition on a cleansing pad or equivalent item that provides a matrix for the product, rubbing the pad between the fingers to work up a microbubble lather, using the pad to remover oily debris or cosmetics from the eye area, rinsing the eye area with clean, warm water, and gently drying same. In this manner the present composition can perform its function as a gentle, non-irritating cleansing agent for human tissues, and particularly for use on human tissues surrounding the eye, or even on the ocular tissue, itself. The present composition is satisfactory to act as a cleanser for nonbiological surfaces which are then placed on ocular surfaces.

It will be apparent to those of skill in this art that certain alterations and modifications of the present composition as disclosed hereinbefore may be made. As to all such obvious alterations and modifications, we desire that they be included within the purview and spirit of our invention, which is to limited only by the scope, including equivalents, of the following, appended claims.

What is claimed is:

1. A mild liquid surfactant composition having good foaming characteristics and such non-irritating characteristics that it is used on periocular surface tissues, comprising:

(a) an anionic surfactant having high foaming properties and being mildly irritating to human tissues, said surfactant being present in cleansing quantities;

(b) a relatively low melting point nonionic surfactant;

(c) another nonionic surfactant having a high melting point relative to the melting point of said low melting point nonionic surfactant, (d) said low and high melting point nonionic surfactants together being present in a total amount capable of reducing the irritant properties of said anionic surfactant and of emulsifying or solubilizing body surface physiologic debris, and individually being present in relative amounts to adjust the viscosity of said resulting composition to a predetermined value;

(e) an amine oxide in an amount sufficient to enhance the foaming properties of the anionic and nonionic surfactants while further reducing the irritating characteristics of the anionic surfactant;

(f) the pH of said composition being maintained substantially at neutrality, at which said amine oxide is induced to act as a nonionic surfactant rather than display the ionic properties it exhibits in an acid medium.

2. A surfactant composition as claimed in claim 1, in which said relatively low melting point nonionic surfactant melts at approximately 40° to 44° C. and said relatively high melting point nonionic surfactant melts at about 50° to 54° C.

3. A surfactant composition as claimed in claim 1, in which said relatively low and high melting point surfactants are present in a ratio of about 1:4.

4. A surfactant composition as claimed in claim 1, in which said relatively low melting point nonionic surfactant is composed of ethoxylated glyceryl cocoate.

5. A surfactant composition as claimed in claim 1, in which said relatively high melting point nonionic surfactant is composed of ethoxylated glyceryl tallowate.

6. A surfactant composition as claimed in claim 4, in which said relatively high melting point nonionic surfactant is composed of ethoxylated glyceryl tallowate.

7. A surfactant composition as claimed in claim 1, in which the ratio of said low melting point nonionic surfactant to said high melting point nonionic surfactant varies between about 1:1 to 1:8.

8. A surfactant composition as claimed in claim 1, in which the ratio of said anionic surfactant to the total of said low melting point and said high melting point nonionic surfactants varies between about 1:1 to 1:4.

9. A surfactant composition as claimed in claim 8, in which the ratio of said anionic to the total of said low melting point and said high melting point nonionic surfactants is about 3:5.

10. A surfactant composition as claimed in claim 1, in which the ratio of said anionic surfactant to said amine oxide varies between about 1:0.1 to 1:4.

11. A surfactant composition as claimed in claim 1, in which the ratio of said anionic surfactant to said low melting point nonionic surfactant to said high melting point nonionic surfactant to said amine oxide is approximately 3:1:4:2.

12. A mild liquid surfactant composition having good foaming characteristics, comprising:

(a) an anionic surfactant having high foaming properties and being mildly irritating to human tissues, said surfactant being present in cleansing quantities;

(b) a relatively low melting point nonionic surfactant which has a melting point in a range of about 40° to 44° C.;

(c) another nonionic surfactant having a high melting point relative to the melting point of said low melting point nonionic surfactant, the melting point of said high melting nonionic surfactant being in a range of about 50° to 54° C.;

(d) said low and high melting point nonionic surfactants together being present in a total amount capable of reducing the irritating properties of said anionic surfactant and of emulsifying or solubilizing body surface physiologic debris, and individually being present in relative amounts to adjust the viscosity of said resulting composition to a predetermined volume, the ratio of said anionic surfactant to the total amount of said nonionic surfactants varying from about 1:1 to 1:4; and (e) an amine oxide in an amount sufficient to enhance the foaming properties of the anionic and nonionic surfactants while further reducing the irritating characteristics of the anionic surfactant, the ratio of said anionic surfactant to said amine oxide varying from about 1:0.1 to 1:4;

(f) the pH of said composition being maintained substantially at neutrality, at which said amine oxide is induced to act as a nonionic surfactant rather than display the ionic properties it exhibits in an oxide medium.

* * * * *